US005436551A

United States Patent [19]

Myer

[11] Patent Number: 5,436,551

[45] Date of Patent: Jul. 25, 1995

[54] MICROPOWER REGULATOR

[75] Inventor: Robert E. Myer, Denville, N.J.

[73] Assignee: AT&T Corp., Murray Hill, N.J.

[21] Appl. No.: 99,782

[22] Filed: Jul. 30, 1993

[51] Int. Cl.[6] ..... G05F 1/46

[52] U.S. Cl. ..... 323/274; 323/223

[58] Field of Search ..... 323/274, 281, 275, 276, 323/220, 223, 226

[56] References Cited

U.S. PATENT DOCUMENTS

| | | | |
|---|---|---|---|
| 3,761,801 | 9/1973 | Sheng | 323/274 |
| 4,500,880 | 2/1985 | Gomersall et al. | 340/825.35 |
| 4,716,359 | 12/1987 | Numata et al. | 323/349 |
| 4,937,586 | 6/1990 | Stevens et al. | 343/702 |
| 5,003,454 | 3/1991 | Bruning | 363/81 |

FOREIGN PATENT DOCUMENTS

| | | | |
|---|---|---|---|
| 515097 | 9/1976 | U.S.S.R. | 323/274 |

OTHER PUBLICATIONS

Electronics, vol. 52 No. 8 Kelvin Shih, Micropower regulator has low dropout voltage Apr. 12, 1979.

Headquarters, Dept. of the Army, Washington DC, Technical Manual, TM 11-690, pp. 1, 98 and 99, dated Mar. 17, 1959, "Basic Theory and Application of Transistors".

Motorola Publication, "Linear And Interface Integrated Circuits", Series G, Printing 1990, p. 1/Introduction; pp. 5-4 and 5-6.

Motorola Publication, "Small-Signal Transistors, FETs And Diodes", Printing 1991, p. 1/Introduction; pp. 3-29, 3-88 and 3-89.

*Primary Examiner*—Thomas M. Dougherty
*Assistant Examiner*—Adolf Berhane
*Attorney, Agent, or Firm*—Ruloff F. Kip, Jr.

[57] ABSTRACT

A rectifier-capacitor power supply has source terminals across which is connected the series combination of a voltage dropping resistor and a transistor circuit comprising (a) an NPN resistor connected in a common emitter configuration and having its collector connected by a load resistor to the voltage dropping resistor, and (b) a PNP transistor connected in a common collector configuration across the series combination of the NPN transistor and its load transistor. A pair of output terminals for a load are connected to opposite ends of that last named series combination. Also connected between those opposite ends is a voltage divider circuit consisting of two resistors in series and having a junction directly connected to the base of the NPN transistor. The circuitry described above as present between such source terminals and output terminals serves to keep substantially constant the voltage across such output terminals despite impedance in a load connected thereto or variations in the voltage across the source terminals.

7 Claims, 2 Drawing Sheets

MICROPOWER REGULATOR

FIELD OF THE INVENTION

This invention relates generally to DC power supplies of which the output voltage is regulated to keep it substantially constant. More particularly, this invention relates to DC power supplies of such kind which are designed to provide electrical loads therefor with DC energy at voltage and current values commonly used in electrically energizing semiconductor circuitry and other devices operating within the same voltage-current ranges as semiconductor devices.

BACKGROUND OF THE INVENTION

My co-pending application Ser. No. 08/085,090, filed Jun. 30, 1993 for "Indoor Wireless Transmitter-Receiver System" and assigned to the assignee hereof discloses a system in which a transmitter of electromagnetic waves is used with a plurality of data handling devices to individually control these devices by way of a wireless coupling thereto so as to selectively cause each of these devices to perform one or more data-related functions. Such devices may be, for example, price label devices (i.e., shelf tags) which provide by respective panel displays the prices of adjacent goods on shelves in a store, and which devices include antenna pick up coils and semiconductor circuitry enabling such devices to be controlled by the waves from the transmitter to up-date from time to time the prices displayed thereby. Such price label devices use no batteries. Instead, they obtain all the electricity needed for their operation through the incorporation in the devices of DC power supplies which convert into DC energy the AC energy in the waves received by the pick-up coils of the devices, and which power supplies furnish such DC energy to the rest of the electrically operated circuits and elements included in these devices. Since, however, electric power is transferable from the transmitter via the electromagnetic waves therefrom to such devices, at only a very low power level as, say, 10 microwatts on the average, it is desirable that the mentioned power supplies divert very little of such power for their internal operation which produces output voltage regulation. Further, since the unregulated voltages of such supplies can vary over a wide range as, say, from 2 volts to over 100 volts in dependence on how close those coils are to the transmitter, there is a need for the DC power supplies to be capable of limiting their output voltages to a much smaller range of variation than that wide range of variation of unregulated voltage.

SUMMARY OF THE INVENTION

These and other needs are met according to the invention by providing regulated supplies of DC power of the character set out by the appended claims.

BRIEF DESCRIPTION OF DRAWINGS

For a better understanding of the invention, reference is made to the following description of an exemplary embodiment thereof and to the following drawings wherein.

DETAILED DESCRIPTION OF EMBODIMENT

Figure 1:
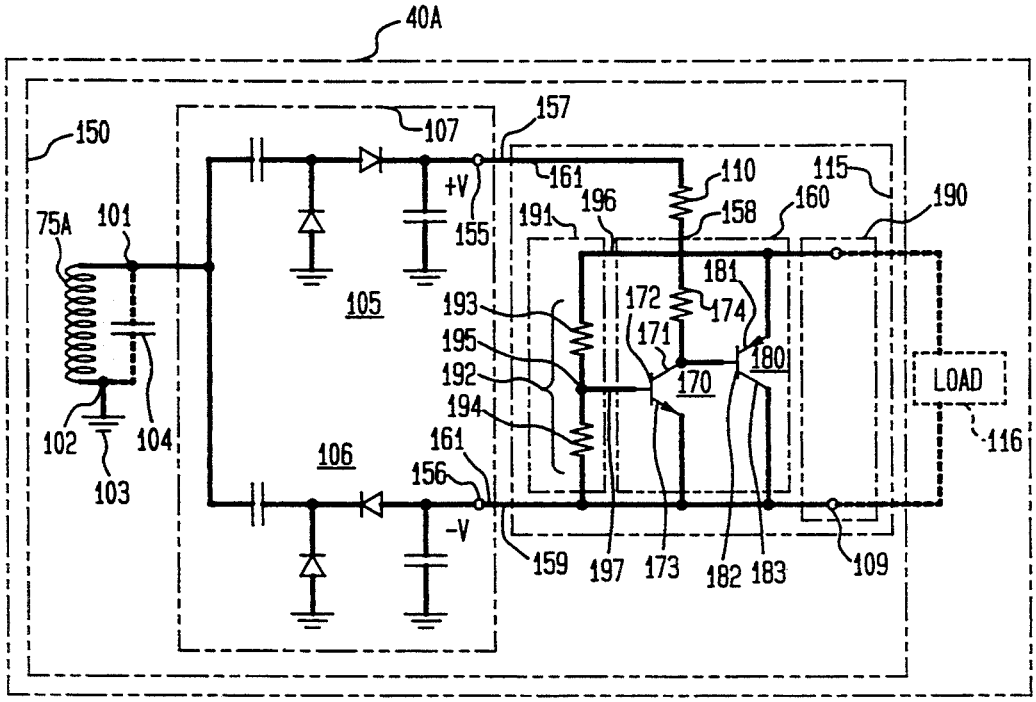
FIG. 1 is a schematic diagram of a regulated DC power supply according to the invention.

Referring now to FIG. 1, the reference numeral 75*a* designates a multi-turn coil of insulated wire which serves as an antenna pick-up coil for a price label transceiver device 40*a* which is of the character earlier described herein.

Circuit details of the transceiver device 40*a* are disclosed in my aforementioned co-pending application incorporated herein by reference and made a part hereof. The device 40*a* includes a regulated supply of DC power 150 of which the pick-up coil 75*a* of that supply 150 has a resistance of about 3000 ohms and is made resonant at the frequency of the waves transmitted thereto by distributed capacitance represented in FIG. 1 by the dotted-line capacitor 104 shown as connected between the high and low ends 101 and 102 of the coil between which the coil's wire extends. Low end 102 of the coil is shown connected to a ground 103 but such ground is only an electrically isolated internal ground for device 40*a* since the device has no external grounding to earth.

The high end 101 of coil 75*a* is connected to upper and lower capacitor-rectifier circuits 105 and 106 each including two capacitors each of 0.1 microfarad capacitance value. Those circuits 105, and 106 along with coil 75*a* provide for device 40*a* a DC energy source, and the circuits 105, 106 together form an energy converting stage 107 for supplying DC power between power supply terminals 108, of which terminal 108 is connected to circuit 105 through resistance means in the form of a 1 megohm voltage dropping resistor 110. The circuits 105 and 106 are each doublers of the peak voltages of, respectively, the positive and negative half cycles of the AC energy appearing in coil 75*a* between its ends 101,102 and generated therein by the electromagnetic waves received by that coil so as to produce voltages of +V and −V with respect to internal ground 103 on output terminals 108 and 109. Accordingly, stage 107 is a peak voltage quadrupler stage from which can be withdrawn from the stage between terminals 108, 109 DC energy having a voltage which in practice is kept to a value of about 1.5 volts.

To maintain the output of DC power supply 150 at approximately that 1.5 volt value, a power regulator stage 115 (soon to be described in detail) is connected between power supply terminals 108, 109. The stage 115 keeps steady at about 1.5 volts the output voltage of supply 150 which, without the regulation afforded by stage 115, could rise to almost 100 volts if device 40*a* were to be disposed very near the transmitter antenna which is wireless coupled to pick-up coil 75*a*.

The regulated DC power supply 150 supplies DC power to electrically energized means 116 providing a resistive load directly connected between the output terminals 108, 109 of supply 150. Such load 116 comprises various semiconductor signal handling stages, an electrically controlled display panel stage, and a microwave transmitter stage actuated at times to transmit information from device 40*a* to its user, none of such stages being shown in the figures hereof. The load 116 is essentially a resistive load which does not undergo wide changes in its resistance, but which undergoes minor variations in resistance during operation of device 40*a*.

Considering now further details of the regulated DC power supply 150, the DC energy source comprising pick-up coil 75*a* and energy converting stage 107 has first and second source terminals 155, 156 through which that source is connected to power regulator stage 115. Stage 115 is, as later explained, a voltage attenuator means, and that attenuator means comprises resistance means 110 and a transistor means 160. The resistance means 110 and the transistor means 160 are coupled together in series with each other in a DC conductive current path 161 which extends between the source terminals 155 and 156 and which includes a conductor 157 joining the end of resistor 110 away from transistor means 160 to the first source terminal 155, a conductor 158 joining the end of resistor 110 towards transistor means 160 to that means 160 and a conductor 159 joining the end of transistor means 160 away from resistor 110 to the second source terminal 156.

The transistor means 160 comprises an NPN transistor 170 having a collector 171, base 172 and emitter 173. A load resistor 174 for transistor 170 is connected at one end to collector 171 and, at the other end (through conductor 158), to the end of resistor 110 towards the transistor means 160 so as to be coupled through that resistor 110 with the first source terminal 155. The emitter 173 of transistor 170 is connected through conductor 159 with the second source terminal 156.

Transistor means 160 also comprises a second PNP transistor 180 having an emitter 181, a base 182 and a collector 183. The transistor 180 has its emitter 181 connected by a conductor 184 to conductor 158 and its base 182 connected to the collector 171 of transistor 170 so that the transistor 180 is connected between the ends of load resistor 174 which are away from and towards, respectively, the transistor 170. The collector 183 of transistor 180 is coupled through conductor 159 to the second source terminal 156.

Transistor 170 is connected in transistor means 160 in a common emitter configuration to produce a reversal of polarity between the input and output of transistor 170 and transistor means 160 in the sense that a positive-going variation in voltage with respect to conductor 159 which is applied between the base and emitter of transistor 170 will produce in the voltage developed with respect to lead 157 across resistor 110 a negative going variation in that voltage, and conversely. Also, each of the transistor means 170 and 180 is connected in circuit to individually provide a circuit gain in excess of 100, and the transistors are connected together in cascaded relation to endow the two-transistor circuit 160 as a whole with a current gain which approximates the product of those individual current gains so as to be in excess of 10,000. That very large current gain causes a reversed polarity voltage gain of the same order of magnitude to exist between the mentioned voltage variation applied between the base and emitter of transistor 170 and the variation in voltage developed across resistor 110. As later explained, however, that very large current gain afforded by transistor means 160 is not used to produce amplification but, instead, attenuation.

The voltage attenuator means 115 further comprises a DC conductive output circuit means 190 including the output terminals 108 and 109. Terminal 108 is connected to conductor 184 and by it to the electrical junction 158 of the transistor means 160 with resistance means 110, while terminal 109 is connected to conductor 159 and by it to terminal 156, the result being that the terminals 108, 109 are coupled to path 161 on opposite sides of transistor means 160. Output terminals 108, 109 are connectable as shown (FIG. 1) with the utility load 116 to couple that load through conductors 184 and 159 in parallel with the transistor means 160 and in series with the resistance means 110.

The voltage attenuator means still further comprises a DC conductive input circuit means 191 comprising a voltage divider 192 provided by the series combination of an upper resistor 193 (FIG. 1), a lower resistor 194 and a conductor 195 joining the two resistors. The lower end of resistor 194 is connected via conductor 159 to source terminal 156 while the upper end of resistor 193 is connected by a conductor 196 to the junction 158 of the resistance means 110 and the transistor means 160.

The voltage divider 192 is thus coupled in shunt with a portion of the DC conductive circuit path 161 which passes through the transistor means 160. Preferably, that last-named portion includes as resistance therein substantially only the effective resistance of transistor means 160.

By virtue of the voltage divider 192 being so coupled in shunt with a portion of DC conductive path 161 which includes transistor means 160, the voltage divider 192 receives from that path via conductor 196 a variable DC feedback current produced by the voltage developed across transistor means 160. The junction 195 of the resistors 193 and 194 in divider 192 is connected by a conductor 197 to the base 170 of the NPN transistor 170 in transistor means 160 and, in the operation of voltage divider 192, the divider is responsive to the mentioned feedback current to apply to transistor means 160 via conductor 197 a DC base-emitter input signal which varies in magnitude directly with variation in that feedback current. The earlier described coupling of voltage divider 192 in shunt with a portion of DC conductive path 161 permits the divider to be energizable solely through such coupling with all the electrical energy needed by input circuit means 191 to produce that base-emitter input signal.

Figure 2:
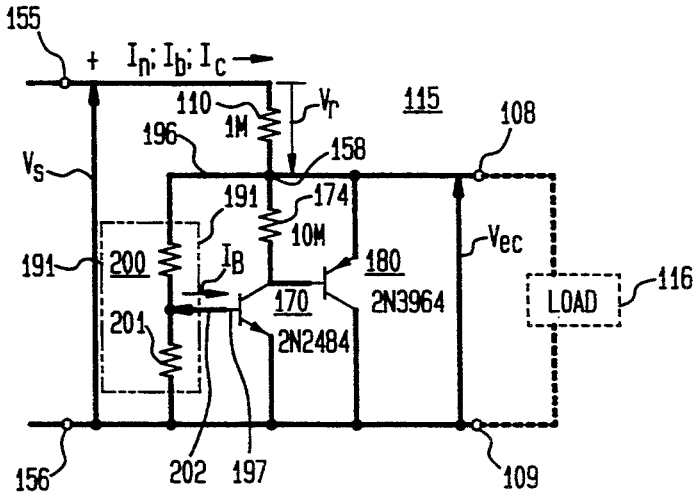
FIG. 2 is a schematic diagram which shows part of the FIG. 1 power supply, and which enlarges on the showing in FIG. 1 of that part of such power supply.

FIG. 2 supplements FIG. 1 in that it sets out the resistance values of resistors 110 and 174, and in that FIG. 2 specifies that the transistors 170 and 180 are, respectively, 2N2484 and 293964 transistors, such transistors being available from the Motorola Company. The resistance values (not shown in FIG. 2) of resistors 193 and 194 are, respectively, 22 megohms and 3.3 megohms.

FIG. 2 also shows that the input circuit means 191 may be modified according to the invention by replacing the multi-resistor voltage divider 192 (FIG. 1) by a potentiometer 200 (FIG. 2) comprising a high resistance linear resistor 201 on which is slidable a contact 202 connected by conductor 197 to the input of transistor means 160. Potentiometer 200 provides the technical advantage over divider 192 that adjustment of the contact 202 on resistor 201 permits adjustment up and down of the average level of the voltage appearing between the output terminals 108, 109 of DC power supply 150 during normal operation of that supply.

USE AND OPERATION OF EMBODIMENT

Figure 3:
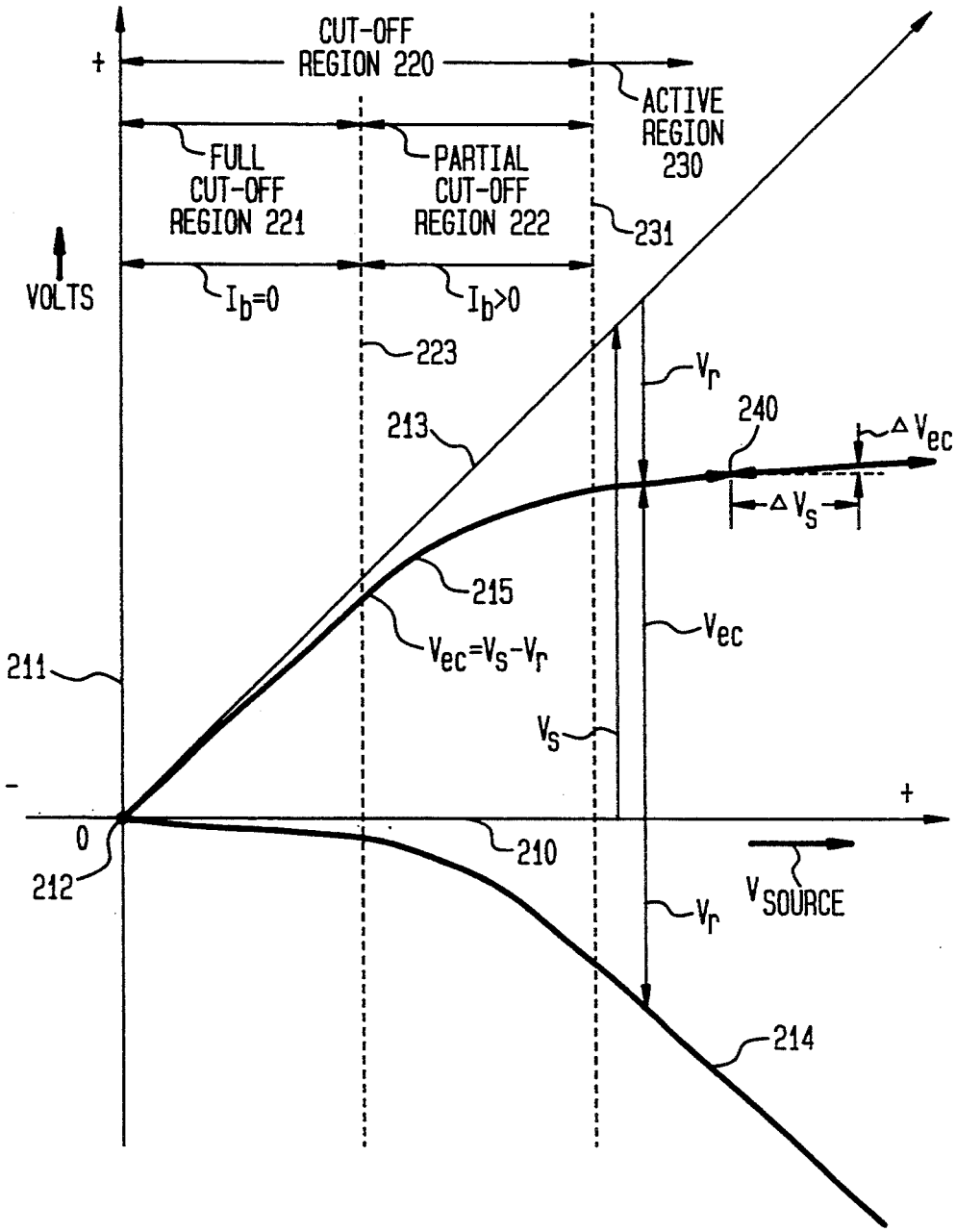
FIG. 3 is a graphical diagram illustrative of the operation of the FIG. 1 power supply.

FIG. 3 is a graphical diagram of voltages which are developed in the course of operation of the embodiment, whether its input circuit means 191 consists of voltage divider 192 (FIG. 1) or potentiometer 200

(FIG. 2). The FIG. 3 diagram has a horizontal ordinate 210 and a vertical ordinate 211, both extending away from the origin 212. Origin 212 corresponds to zero volts for the voltages represented in the diagram. Notwithstanding that FIG. 1 shows for the power supply 150 that an internal ground 103 is connected to the lower end of pick-up coil 75*a*, in explaining by FIG. 3 the operation of that supply, the ground for the circuits of that supply is deemed to exist at source terminal 156 which is deemed to be at zero (0) volts since the explanation is thereby simplified and since, insofar as the principles of operation of the supply 150 are involved, it makes no difference whether the electrical ground is at location 103 or 156.

In the FIG. 3 diagram, a change in displacement in the positive direction away from origin 212 along horizontal ordinate represents a rise in magnitude from terminal 156 to terminal 155 in the source voltage $V_S$ existing between these terminals and considered for the purposes of FIG. 3 as changing as an independent variable. With regard to the vertical ordinate 211, a change in displacement away from origin 212 along that ordinate represents a change in magnitude of either $V_S$ or of other voltages which are considered to be dependent variables of the independent variable $V_S$.

The line 213 in FIG. 3 is a plot of $V_S$ as a dependent variable as well as an independent variable, any point on that line accordingly having equal displacements measured on ordinates 210 and 211 from origin 212. The line 214 is a plot of the dropping in magnitude from terminal 155 to junction 158 of the voltage developed across resistor 110 as the voltage $V_S$ increases. The line 215 is a plot of the algebraic sum of the voltages $V_S$ and $V_R$, such algebraic sum being the voltage which appears across transistor means 160 at junction 158 relative to terminal 156, and which voltage is the emitter-collector voltage $V_{EC}$ of the PNP transistor 180 in transistor means 160 and, also, is the output voltage at terminals 108, 109 of the DC power supply 150.

In discussing the operation of that power supply, it is assumed, unless the context otherwise requires, that flow of current is in the direction of flow of positive charge that the resistance of load 116 remains constant, and that the source voltage $V_S$ starts at zero (0) value and rises in magnitude from that value.

During the initial rise of $V_S$, the magnitude of $V_S$ as applied to regulator stage 115 is of such value as to cause the transistors 170 and 180 in transistor circuit 160 to be within a full cut-off region 221 constituting part of an overall cut-off region of operation 220 which characterizes these transistors and stage 115, and which also includes a partial cut-off region 222. While the stage 115 is within the full cut-off region 221, the base current $I_B$ flowing between input circuit means 191 and the base of transmitter 170 remains essentially at zero value, and the leakage current through the transistors 170 and 180 (from minority carriers therein) is so small that it practically can be, and will be herein, neglected. Nonetheless, the appearance of voltage $V_S$ between terminals 155 and 166 produce a flow through load resistor 110 of a non-transistor DC current $I_N$ (FIG. 2) which is proportional to $V_S$ and which, after it passes through resistor 110, splits into subcurrents passing through load 116 and the input circuit means 191. The flow of that current $I_N$ through load resistor 110 causes the voltage $V_R$ to be substantially proportional to $V_S$. Hence, while the operation of supply 150 is in full cut-off region 221, the voltage $V_{EC}$ is substantially proportional to $V_S$ and rises linearly as $V_S$ rises.

With continuing rise in $V_S$, its plot line 213 crosses in FIG. 3 the line 223 demarcating the full cut-off region 221 from the partial cut-off region 222, and the condition of operation of the regulator stage 115 moves into that latter region. Within region 222, there is added to the non-transistor current $I_N$ in stage 115 a significant flow of base current $I_B$ from input circuit means 191 to the base of transistor 170 to thereby cause that transistor to draw collector current passing from junction 158 through the transistor and out its emitter to terminal 156. In turn, the flow of that collector current produces across resistor 174 a voltage applied between the emitter and base of transistor 180 and sufficient to turn it on and draw collector current passing to terminal 156. The respective collector currents through the transistors 170 and 180 together form for the whole transistor circuit 160 a collector current $I_C$ which passes through the load resistor 110 to contribute (along with the current $I_B$) to the voltage $V_R$ across that resistor.

The effect of the happenings just described is that, within the partial cut-off region 222, there is established a feedback loop which involves (a) the voltage $V_{EC}$ developed across transistor means 160, (b) the resultant amount of base current $I_B$ flowing through resistor 110 to that transistor means, (c) the resultant amount of collector current $I_C$ drawn by transistor means 160 and passing through resistor 110, and (d) the contribution of the flow of currents $I_B$ and $I_C$ through resistor 110 to the voltage drop $V_R$ developed across that resistor, and any increase of which drop $V_R$ reduces the voltage $V_{EC}$ across transistor means 160. The overall result of the action of such feedback loop is that the voltage $V_{EC}$ rises more slowly per unit increase of $V_S$ in the partial cut-off region 222 than $V_{EC}$ does in the full cut-off region 221.

Within the region 222, the flow of base current $I_B$ to the transistor means 160 is a non-linear function of $V_S$. That is, if a plot (not shown herein) is made of the variation of $I_B$ in response to variation of $V_S$ the resulting plot line will consist of (a) a left hand line segment representing values of $V_S$ in region 221 at which $I_B$ is close to zero such that the segment starts at 0 for $I_B$ and slopes upward only very gradually to the right, (b) a middle line segment in region 222 at which $I_B$ starts to flow significantly and progressively increases as $V_S$ increases, and which middle line segment consists of a pronounced knee with a slope which rapidly increases as $V_S$ increases, and (c) a right hand line segment of which the slope of the segment is steep but is close to being constant and increases only very gradually with increase in $V_S$. Such curve for the plot of $I_B$ as function of $V_S$ in region 222 results in the curve or "knee" shown in FIG. 3 in that region 222 for the plot line 215 of $V_{EC}$ as a function of $V_S$. To operate supply 150 in region 222 which includes the curve shown as characterizing line 215 in that region would not provide the best regulation of the output voltage $V_{EC}$ of the supply. Thus the circuit and operating parameters of supply 150 are selected to cause, when possible, the normal condition for obtaining voltage regulation to be when $V_S$ is of values which characterize the right-hand line segment of the $I_B$–$V_S$ plot not shown but just described and which brings the regulator stage 115 within the region 230 which is shown in FIG. 3 and which is the active region of operation for the transistor means 160.

In FIG. 3, the nominal normal operating value chosen for the output voltage $V_{EC}$ from supply 150 is represented by the point 240 lying on plot line 215 in region 230. While, for convenience of illustration, normal operating point 240 is shown as being fairly close to the dash line 231 demarcating active region 230 from cut-off region 220, ordinarily point 240 would be located along line 215 about farther towards the saturation region for operation of the transistors in stage 115, such saturation region being not shown in FIG. 3 but being well to the right of the portion of the active region 230 shown in that figure.

In the vicinity of the point 240, the voltage $V_{EC}$ remains, as shown by line 215, substantially constant in magnitude despite substantial variations in magnitude occurring in the source voltage $V_S$. To put it another way, in the vicinity of point 240, a change $\Delta V_S$ in the voltage $V_S$ will produce a change $\Delta V_{EC}$ in the voltage $V_{EC}$ which is so small in relation to $\Delta V_S$ as to be less than 1% of $\Delta V_S$. Further, in the vicinity of point 240, the slope $\Delta V_{EC}/\Delta V_S$ of line 215 changes so little that, for the purposes of operating supply 150, such slope is substantially constant. The described power supply 150 provides, therefore, excellent regulation of the voltage at its output terminals 108, 109 in the presence of a large Variation in the voltage across its source terminals 155, 156.

It has been assumed so far that the resistance of load 116 remains constant. If however that resistance changes, the regulator stage will respond to that change in load to tend to keep constant the output voltage $V_{EC}$. For example, if the resistance of load 116 appreciably increases so as to tend to reduce the current $I_N$ and thereby raise the voltage $V_{EC}$ at junction 158, the transistor circuit 160 will draw more collector current $I_C$ to thereby maintain the voltage $V_{EC}$ almost at the value it had before the load change.

In the operation of power supply 150, the regulator stage 115 acts as an attenuator rather than an amplifier despite the high current gain provided the. transistor circuit 160. That is, if the output of the stage 115, in response to variation in its input $V_S$, is considered to be the variation in $V_R$ resulting from that $V_S$ variation, then the $V_R$ variation will always somewhat be attenuated in relation to the corresponding $V_S$ variation and, likewise, if the output of the stage in response to the input $V_S$ variation is considered to the resulting variation in the voltage $V_{EC}$, then that $V_{EC}$ variation will always be greatly attenuated in relation to the input $V_S$ variation as described in detail above, wherefore attenuation occurs whether the $V_R$ variation or the $V_{EC}$ variation is deemed to be the output of stage 115.

Emphasis has been placed above on the advantage of power supply 150 being able to provide good regulation of its output voltage when device 40a is positioned close enough to the transmitter antenna for the AC electromagnetic wave energy picked up by coil 75a of the device to cause generation between source terminals 155, 156 of a voltage of, say, about 4 volts which permits operating point 240 to be in region 230, and the nominal value for the output voltage $V_{EC}$ to be 1.5 volts (it being assumed that load 116 then has a resistance of 1 megohm, and the total current through voltage resistor 110 is then 2.5 microamperes with 1.5 microamperes and 1.0 microamperes of that current passing through, respectively, load 116 and regulator stage 115). Perhaps even more important, however, is the advantage afforded by supply 150 of being able to operate and provide output voltage regulation in the circumstance where the device 40a is so far from the transmitter antenna that the voltage developed across the source terminals 155 and 156 is only about 2 volts, and the regulator stage 115 and load 116 together draw through voltage dropping resistor 110 only about 1.0 microampere of current producing a 1.0 volt drop across the one megohm load 116, almost all of that current passing through the load (which starts to operate when the voltage across it reaches about 1.0 volt) and practically none of that current passing through the regulator stage 116. In that circumstance of very low electrical energy wirelessly coupled to device 40a, its power supply 150 is still able, with such current of about 1.0 microampere drawn from its AC-DC converting stage 107, to provide an output voltage to the load 116 in such manner that as $V_X$ increases beyond 2 volts almost all of the current drawn from stage 107 still goes to load 116 and very little of it is used to provide the voltage regulation. The reason for this is that the current and voltage gain in excess of 10,000 which characterizes transistor circuit 160 serves to sharpen the knee of the earlier described but unshown $I_B$–$V_S$ plot line to shift rightward in FIG. 3 towards line 231 the line 223 (as compared to where line 223 would be relative to line 231 with no or less such voltage and current gain) so as to prolong the extent of increase in $V_S$ over which $I_B$ and $I_C$ remain close to zero, and so that an increase of only about 0.2 or less volt is required in $V_S$ (FIG. 3) for the plot line 215 to pass from full cut-off region 221 over and beyond the knee of plot line 215 and into active region 230. That small increase in applied voltage needed to pass beyond the knee of the voltage regulating plot line 215 shown in FIG. 3 stands in contrast to the function of applied voltage vs. resulting current which characterizes the operation of Zener diodes often used for voltage regulating purposes, and in which, as exemplified by the Motorola LM285 and LM385 diodes, an increase in applied voltage in excess of one volt is required in order to pass from the low voltage side to the high voltage side of the knee of the diode's voltage-current curve.

The above described embodiment being exemplary only, it is understood that additions thereto, omissions therefrom and modifications thereof can be made without departing from the spirit of the invention. For example, the transistor means 160 may consist of only the one transistor 170 rather than the two transistors 170 and 180 although the employment of such two transistors is preferred because the high current gain afforded by these two transistors causes the plot line (FIG. 3) 215 of voltage $V_{EC}$ to have in region 230 a much smaller slope than if only the one transistor were used.

Accordingly, the invention is not to be considered as limited save as is consonant with the scope of the following claims.

I claim:

1. A regulated supply of DC power comprising: DC energy source having a pair of source terminals for providing a DC output of source voltage appearing between said terminals, voltage attenuator means comprising; transistor means and non-transistor resistance means, said transistor means comprising at least one transistor having a semiconductive body and a base, emitter and collector, said transistor means and non-transistor resistance means being coupled together in series with each other in a DC conductive circuit path extending between said terminals and including said non-transistor resistance means and said body and collector and emitter of said transistor, DC conductive output circuit means including output terminals of said supply and DC coupled to said path on opposite sides of said transistor means and connectable with a utility load to DC couple said load in parallel with said transistor means and in series with said resistance means, and DC, conductive input circuit means DC coupled with said path to be in series with said non-transistor resistance means and in parallel with said transistor means so that said input circuit means receives from said path a variable DC feedback current produced by the voltage developed across said transistor means, said input circuit means being responsive to said feedback current to apply to said transistor means a DC base-emitter input signal which varies in magnitude directly with variation in said feedback current, said input circuit means being energizable through such shunt coupling thereof with said path with all the electrical energy required by said input circuit means to produce said DC base-emitter input signal, and said transistor means being responsive, in the active region thereof between cut off and saturation, to changes in the magnitude of said source voltage to produce attenuation in the magnitude of corresponding changes produced by said source voltage changes in the voltage between said output terminals of said supply so as to keep said voltage between said output terminals substantially constant, said DC energy source comprising an energy converting stage including rectifier means and capacitor means responsive to an input of AC energy to convert it into DC energy and store said DC energy.

2. A regulated supply according to claim 1 in which said supply further comprises a multi-turn wire antenna pick-up coil coupled to said energy-coverting stage and responsive to low frequency electromagnetic waves received by said coil to provide said input of AC energy to said stage.

3. A regulated supply according to claim 1 in which said one transistor is a first transistor in said transistor means, and in which said transistor means further comprises a load resistor included in said DC conductive circuit path and coupled at one end of said resistor to said collector of said first transistor, said load resistor and the collector and emitter of said first transistor being connected in series between said output terminals, the base of said first transistor being coupled to said input circuit means, and said transistor means still further comprising a second transistor having its emitter and collector connected to respective ones of said output terminals, and having its emitter and base coupled to, respectively, the ends of said load resistor which are located, respectively, away from and towards said collector of said first transistor.

4. A regulated supply according to claim 3 in which said first and second transistors are, respectively, NPN and PNP transistors.

5. A regulated supply according to claim 4 which said first and second transistors are, respectively, 2N2484 and 2N3964 transistors.

6. A regulated supply of DC power comprising: an energy converting stage including rectifier means and capacitor means responsive to an input of AC energy to convert it into DC energy and store said DC energy, said stage having first and second source terminals for providing a DC output of source voltage appearing between said terminals, transistor means and resistance means DC coupled together in series in a DC conductive circuit path between said source terminals with said resistance means and transistor means being relatively nearer to, respectively, the first and second of said source terminals, said transistor means comprising; an NPN transistor and a load resistor therefor DC coupled in series with said NPN transistor being coupled between said resistance means and the second of said terminals, said load resistor being coupled to the collector of said first transistor, and the emitter of said first transistor being coupled to said second terminal, a PNP transistor having its emitter and base respectively DC coupled to the ends of said load resistor relatively further from and nearer to said first transistor, and said PNP transistor having its collector DC coupled to said second terminal, said supply further comprising a voltage divider DC coupled between said second terminal and a connection with said path intermediate said resistance means and said transistor means, said NPN transistor having its base coupled to a portion of said voltage divider intermediate its ends, and said supply further comprising first and second output terminals of which said first output terminal is DC coupled to said connection and said second output terminal is coupled to said second source terminal, said resistance means, said transistor means and said voltage divider being cooperably responsive to dynamic changes in the magnitude of said source voltage to produce attenuation in the magnitude of corresponding dynamic changes produced by said source voltage changes in the voltage between said output terminals so as to keep that output voltage substantially constant.

7. A regulated supply according to claim 6 further comprising a multiturn wire antenna pick-up coil coupled to said stage and responsive to low frequency electromagnetic waves received by said coil to provide said input of AC energy to said stage.

* * * * *